US007390610B2

(12) United States Patent
Day

(10) Patent No.: US 7,390,610 B2
(45) Date of Patent: Jun. 24, 2008

(54) COLOR FORMING COMPOSITION

(75) Inventor: Michael J. Day, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 301 days.

(21) Appl. No.: 11/253,772

(22) Filed: Oct. 18, 2005

(65) Prior Publication Data

US 2007/0087293 A1 Apr. 19, 2007

(51) Int. Cl.
*G03C 1/494* (2006.01)
*G03C 1/492* (2006.01)
*G03C 1/76* (2006.01)

(52) U.S. Cl. ..... 430/270.1; 430/20

(58) Field of Classification Search ..... 430/270.1, 430/20

See application file for complete search history.

(56) References Cited

U.S. PATENT DOCUMENTS

| | | | | |
|---|---|---|---|---|
| 6,740,465 | B2 | 5/2004 | Liang et al. | |
| 2002/0155372 | A1 | 10/2002 | Liang et al. | |
| 2004/0146812 | A1 | 7/2004 | Gore et al. | |
| 2005/0053860 | A1 | 3/2005 | Gore | |
| 2005/0089782 | A1 | 4/2005 | Kasperchik et al. | |
| 2006/0147833 | A1* | 7/2006 | Kasperchik et al. | 430/270.1 |
| 2007/0037088 | A1* | 2/2007 | Kasperchik et al. | 430/270.1 |

* cited by examiner

*Primary Examiner*—Geraldina Visconti

(57) ABSTRACT

The present disclosure discloses a color former phase. According to one exemplary embodiment discussed herein, an exemplary color former phase includes at least one color former, a radiation absorber, and an acrylic resin, in which the color former, the radiation absorber, and the acrylic resin form an amorphous solid.

30 Claims, 4 Drawing Sheets

COLOR FORMING COMPOSITION

BACKGROUND

Compositions that produce a color change upon exposure to energy in the form of light or heat are of great interest in generating images on a variety of substrates. For example, data storage media provide a convenient way to store large amounts of data in stable and mobile formats. For example, optical discs, such as compact discs (CDs), digital video disks (DVDs), or other discs, allow a user to store relatively large amounts of data on a single relatively small medium. Data on such discs often includes entertainment, such as music and/or images, as well as other types of data. In the past, consumer devices were only configured to read the data stored on optical disks, not to store additional data thereon. Consequently, any data placed on the optical disks was frequently placed thereon by way of a large commercial machine that burned the data onto the disc. In order to identify the contents of the disc, commercial labels were frequently printed onto the disc by way of screen printing or other similar methods.

Recent efforts have been directed to providing consumers with the ability to store data on optical disks. Such efforts include the use of drives configured to burn data on recordable compact discs (R-CD), rewritable compact discs (RW-CD), recordable digital video discs (R-DVD), and/or rewritable digital video discs (RW-DVD) to name a few. These drives provide a convenient way for users to record relatively large amounts of data that may then be easily transferred or used in other devices.

The optical disks used as storage mediums frequently have two sides: a data side configured to receive and store data and a label side. The label side is frequently a background on which the user hand writes information to identify the disc.

SUMMARY

A color former phase, includes a color former, a radiation absorber, and an acrylic resin, wherein the color former, the radiation absorber, and the acrylic resin form an amorphous solid.

BRIEF DESCRIPTION OF THE DRAWINGS

The accompanying drawings illustrate various embodiments of the present apparatus and method and are a part of the specification. The illustrated embodiments are merely examples of the present apparatus and method and do not limit the scope of the disclosure.

Throughout the drawings, identical reference numbers designate similar, but not necessarily identical, elements.

DETAILED DESCRIPTION

The present compositions and methods provide for the preparation of a colorable and/or surface-treated radiation image-able substrate. The present compositions and methods can be disposed onto a substrate and used in structures such as, but not limited to, paper, digital recording material, and the like.

Further details of the above-mentioned compositions and methods will be provided below.

In the following description, for purposes of explanation, numerous specific details are set forth in order to provide a thorough understanding of the present compositions and methods. It will be apparent, however, to one skilled in the art that the present compositions and methods may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Schematic View of a Media System

Figure 1:
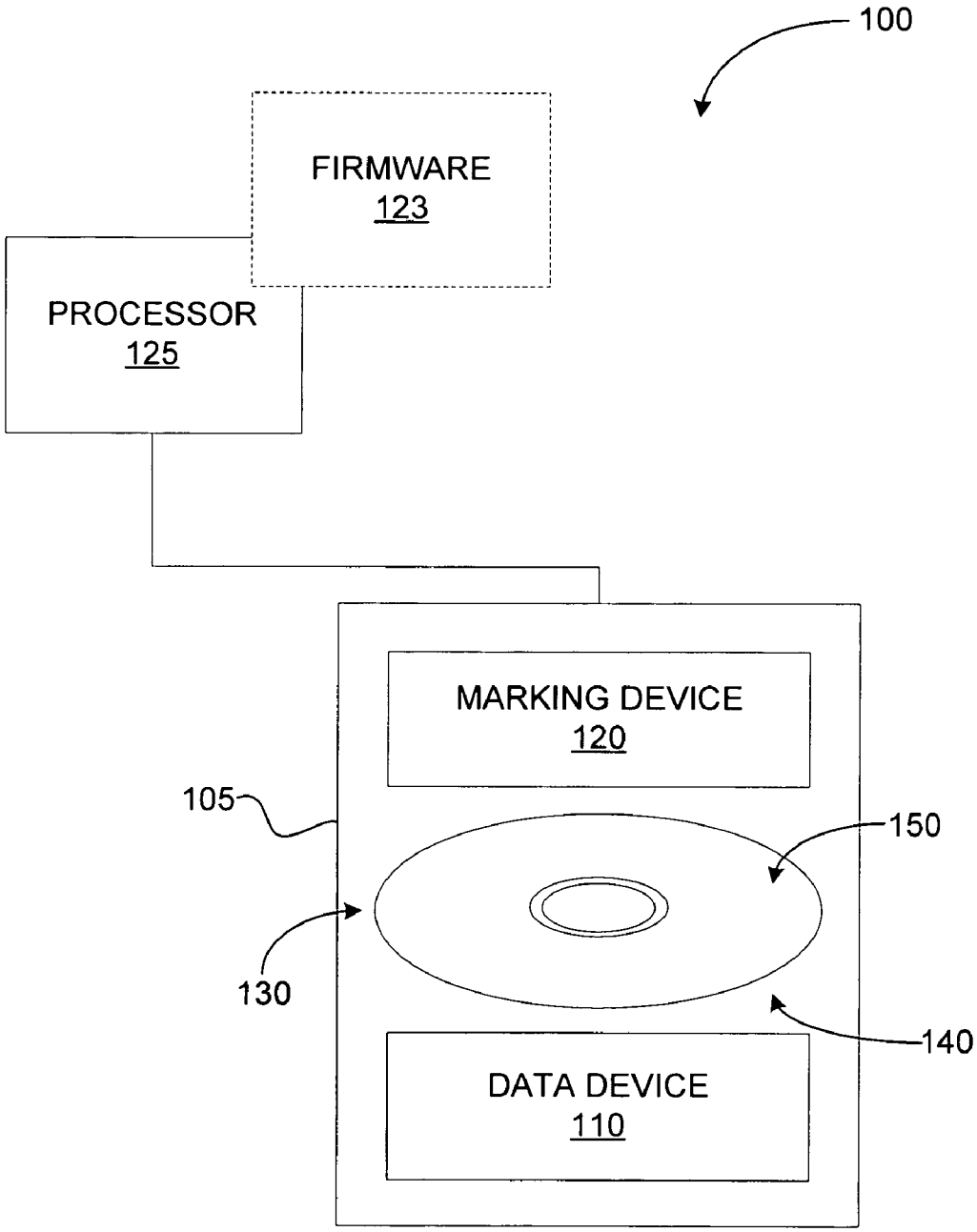
FIG. 1 illustrates a schematic view of a media processing system according to one exemplary embodiment.

FIG. 1 illustrates a schematic view of a media processing system (100), according to one exemplary embodiment. As will be described in more detail below, the media processing system (100) allows a user, among other things, to expose a radiation image-able surface with coatings of the present exemplary compositions, register an image on the coatings, and use the imaged object for a variety of purposes. For example, according to one exemplary embodiment, a radiation image-able data storage medium (radiation image-able disc) may be inserted into the media processing system (100) to have data stored and a graphic image formed thereon.

Exemplary radiation image-able discs include, but are in no way limited to, audio, video, multi-media, and/or software disks that are machine readable in a CD and/or DVD drive, or the like. Examples of radiation image-able disc formats include, but are in no way limited to, writeable, recordable, and rewriteable disks such as DVD, DVD-R, DVD-RW, DVD+R, DVD+RW, DVD-RAM, CD, CD-ROM, CD-R, CD-RW, and the like.

The media processing system illustrated in FIG. 1 includes a housing (105) that houses a data device (110) and a marking device (120) coupled to a processor (125). The operation of both the data device (110) and the marking device (120), which may be a laser or other type of device configured to generate electromagnetic radiation, may be controlled by the processor (125). The exemplary media processing system (100) also includes hardware for placing a radiation image-able data storage medium (radiation image-able disc) (130) in a position to be read by the data device (110) and/or marked by the marking device (120). The operation of the hardware may also be controlled by firmware (123) accessible by the processor (125).

The processor (125) shown is separate from the media processing system (100), according to one exemplary embodiment. Exemplary processors (125) may include, without limitation, a computer or other such device. The processor (125) may have firmware (123) such as software or other drivers residing thereon configured to control the operation of the data device and the marking device to selectively read and/or write data to the data storage medium (130). Those of skill in the art will understand that any suitable processor may be used, including, but in no way limited to a processor configured to reside on the media processing system.

As introduced, the data device (110) and the marking device (120) are each configured to interact with a radiation image-able data storage medium (130). In particular, the exemplary radiation image-able disc (130) includes first (140) and second (150) opposing sides. The first side (140)

has a data surface formed thereon configured to store data while the second side (150) includes a radiation image-able surface.

With respect to the first side (140) of the radiation image-able disk (130), the data device (110) may be configured to read existing data stored on the radiation image-able disk (130) and/or to store new data on the radiation image-able disc (130). As used herein, the term "data" is meant to be understood broadly as including the non-graphic information digitally or otherwise embedded on a radiation image-able disc. According to the present exemplary embodiment, data can include, but is in no way limited to, audio information, video information, photographic information, software information, and the like. Alternatively, the term "data" may also be used herein to describe information a computer or other processor may use to form a graphic display on a radiation image-able surface.

As will be discussed in more detail below, the marking device (120) illustrated in FIG. 1 is configured to selectively apply electromagnetic radiation to the radiation image-able surface of the radiation image-able disk (130) to form a graphic display thereon. As used herein, the term "graphic display" can include any visible character, letters, and/or image found on an optical disk. While the graphic display is typically found prominently on one side of the optical disk, this is not always the case. By selectively marking the surface of the second side (150) of the radiation image-able disk (130), the present marking device (120) may form a "label" on the second side. In particular, the radiation image-able surface of the second side (150) of the radiation image-able disk (130) may include color-forming compositions and acrylic resins that react to electromagnetic radiation to form color. Several exemplary color-forming compositions that may be included in the above-mentioned radiation image-able surface will be discussed in further detail below.

Method of Forming Color Forming Composition

Figure 2:
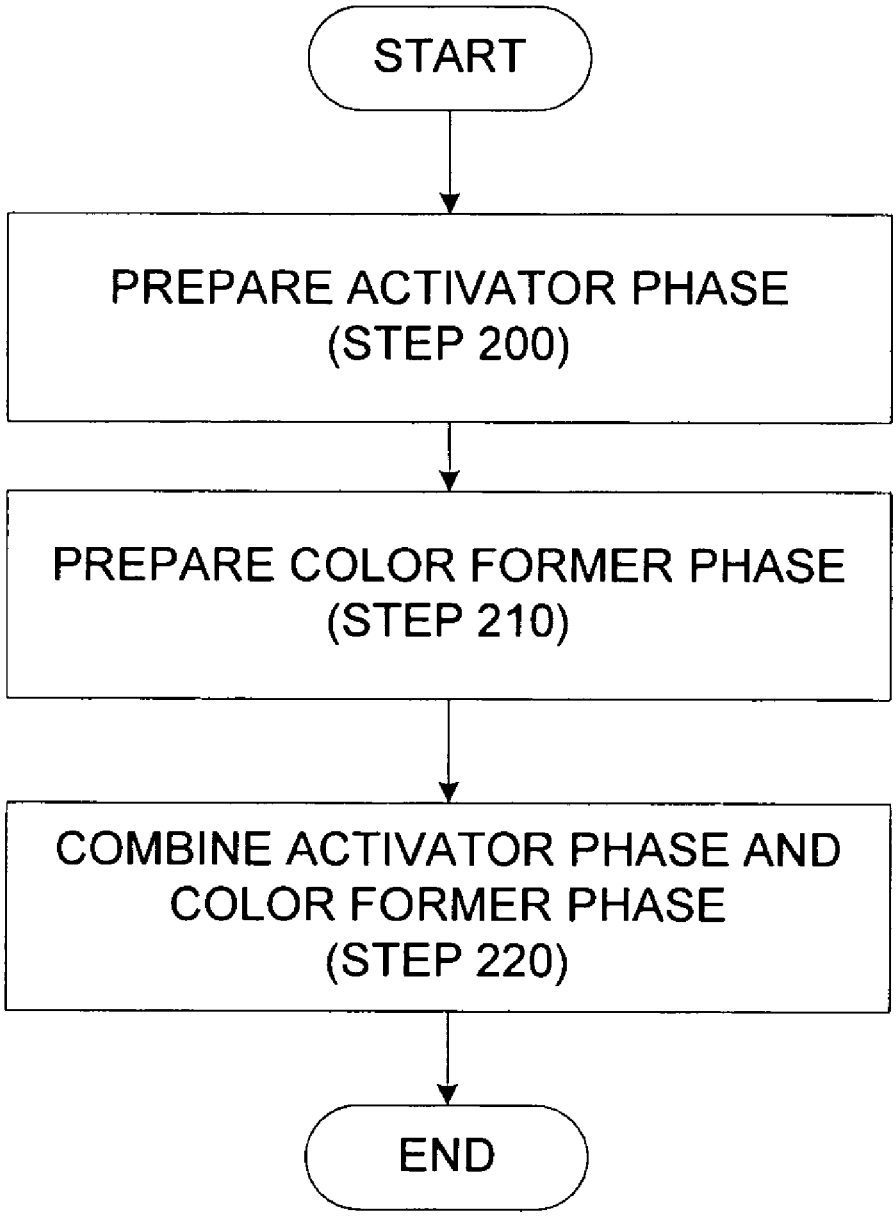
FIG. 2 is a flowchart illustrating a method of forming a composition according to one exemplary embodiment.

FIG. 2 is a flowchart illustrating a method of forming a color forming composition according to one exemplary embodiment. In general, a method of forming a color forming composition includes preparing an activator phase (step 200), preparing a color former phase (step 210), and combining the activator phase and the color former phase to form a color forming composition (step 220). As will be discussed in more detail below, acrylic resins may be used to in the formation of the activator phase and/or the color former phase. The preparation of each of the above-mentioned phases will now be discussed in more detail, with reference to FIGS. 3 and 4.

Alloyed Activator Phase

Figure 3:
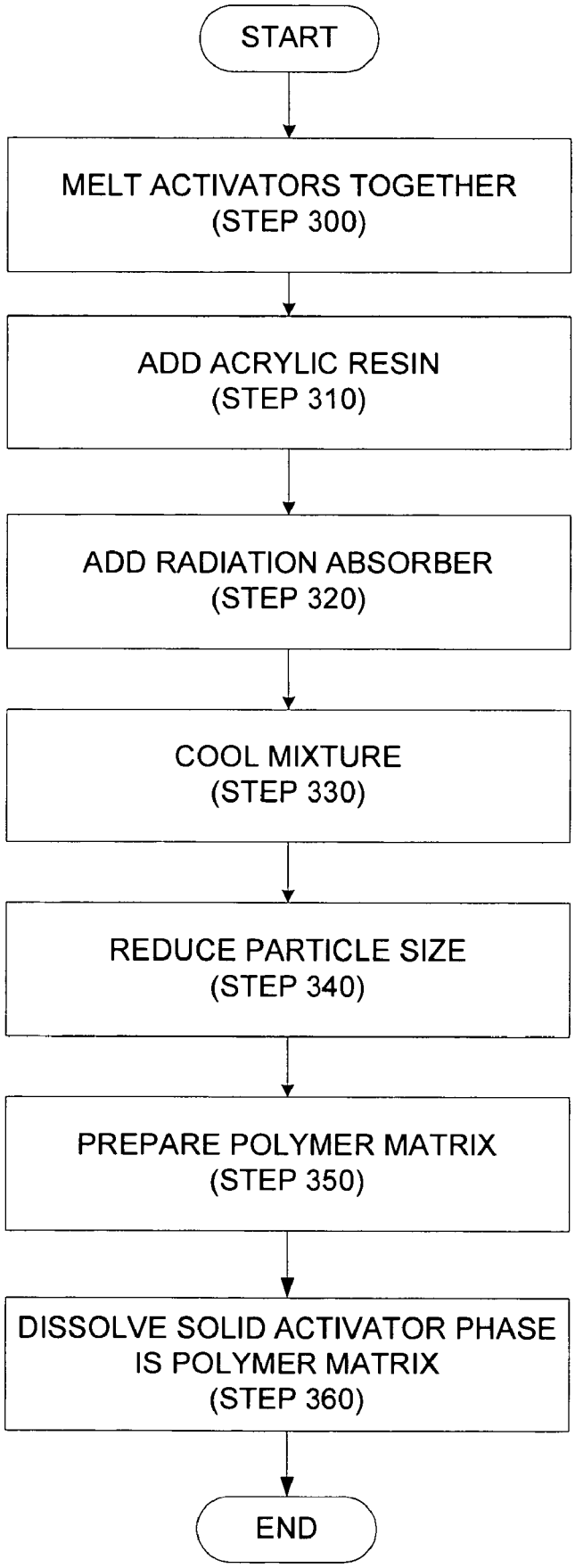
FIG. 3 is a flowchart illustrating a method for forming a radiation image-able composition, according to one exemplary embodiment.

As illustrated in FIG. 3, the activator phase is prepared by melting together a number of activators (step 300). As used herein, the term "activator" refers to compounds or materials that, upon the presence of energy (such as heat generated by a laser and a radiation absorber), can react or otherwise interact with a color former to modify or create color within a color forming composition. In some embodiments, multiple activators can be used, e.g., multiple activator systems having coequal performance values to systems having a primary activator and secondary activator(s). In one exemplary embodiment, the activator can be an acidic compound or material that donates a proton necessary to develop a certain class of color former, such as a leuco dye. For example, according to one exemplary embodiment, a number of phenolic leuco dyes such as 4-4' thiobis(6-tert-butyl-3-methyl) phenol also known as yoshonox SR (YSR) available from API Corporation, 4-4(isopropoxyphenyl sulfonyl)phenol known as D-8 available from Nippon, and bisphenol-s known as SDP available from Lancaster may be melted together.

Once the activators are melted together (step 300), acrylic resin may then added to the molten activators (step 310). According to one exemplary embodiment, suitable acrylic resins include methyl methylacrylates, butyl methylacrylates, and combinations thereof, such as paraloid b-60 available from Rohm and Haas. According to one exemplary embodiment, this phase includes approximately 7% paraloid b-60, 23.4% SDP, 54.8% D-8 and 14.7% YSR.

A radiation absorber is then added to the mixture and dissolved therein (step 320) to form a molten activator phase. For example, a phthalocyanine dye may be added. As used herein, "radiation absorber" refers generally to a radiation-sensitive agent that can generate heat or otherwise transfer energy to surrounding molecules upon exposure to radiation at a specific wavelength or range of wavelengths. The radiation absorber may be selected based on the wavelength or range of wavelengths produced by a desired device. When mixed with and/or in thermal contact with a color former and/or a corresponding activator, a radiation absorber can be present in sufficient quantity so as to produce ample energy to at least partially develop the color former.

For purposes of the present compositions and methods, the term "color" or "colored" refers to absorbance and reflectance properties that are preferably visible, including properties that result in black, white, or traditional color appearance. In other words, the terms "color" or "colored" includes black, white, and traditional colors, as well as other visual properties, e.g., pearlescence, reflectivity, translucence, transparency, etc.

As used herein, "thermal contact" refers to the spatial relationship between a radiation absorber and other members of the color forming composition (including the color former and/or the activator). For example, when a radiation absorber is heated by interaction with electromagnetic radiation, the energy generated by the absorber should be sufficient to cause the color former or color forming composition to darken, lighten, become colored, or otherwise change in visible perception, such as through a chemical reaction.

Thermal contact can include close proximity between a radiation absorber and other members of the color forming composition, which allows for energy transfer from the absorber toward the color former and/or activator. Thermal contact can also include actual contact between a radiation absorber and one or more other members of the color forming composition, such as in immediately adjacent layers, or in an admixture including some or all of the other constituents.

While the present exemplary method includes a radiation absorber in contact with an activator phase, those of skill in the art will appreciate the radiation absorber can be present within the color former phase, within the activator phase, and/or layered with respect to the color former/activator phase dispersion. For example, the radiation absorber may be combined with the color former to create a color former phase and/or combined with a polymeric activator alloy to form a activator phase and/or may be layered between a color former phase and a activator phase.

Once the above components are combined, the molten activator phase is allowed to cool (step 330). As the molten color activator phase cools, the acrylic resin reduces the possibility that the activators and the radiation absorbers will re-crystallize. Thus, as the molten activator phase cools, it solidifies into an amorphous solid activator phase. The cooled, amorphous activator phase may be relatively brittle.

The solid activator phase is then processed to reduce the average size of the particles (step 340). For example, according to one exemplary method, the solid color former phase may be milled to form relatively coarse particles with an average size in the range of about 10 μm to 30 μm.

The present exemplary method also includes the preparation of a polymer matrix (step 350). The particles of the solid activator phase are then combined with the polymer matrix (step 360) to form a polymeric activator alloy phase. For example, according to one exemplary embodiment, the activator phase may be stirred into the polymer matrix. As the activator phase is stirred into the polymer matrix, it may be dissolved therein. Further, the activator phase may be more readily dissolved in the polymer matrix due to the amorphous state of the radiation absorber and the activators. This ready dissolution may thus increase the ease and speed with which the alloyed activator phase is formed. With the alloyed activator phase thus prepared, a color former phase may then be dispersed therein. An exemplary method of preparing a color former phase will now be discussed in more detail.

Preparation of a Color Former Phase

Figure 4:
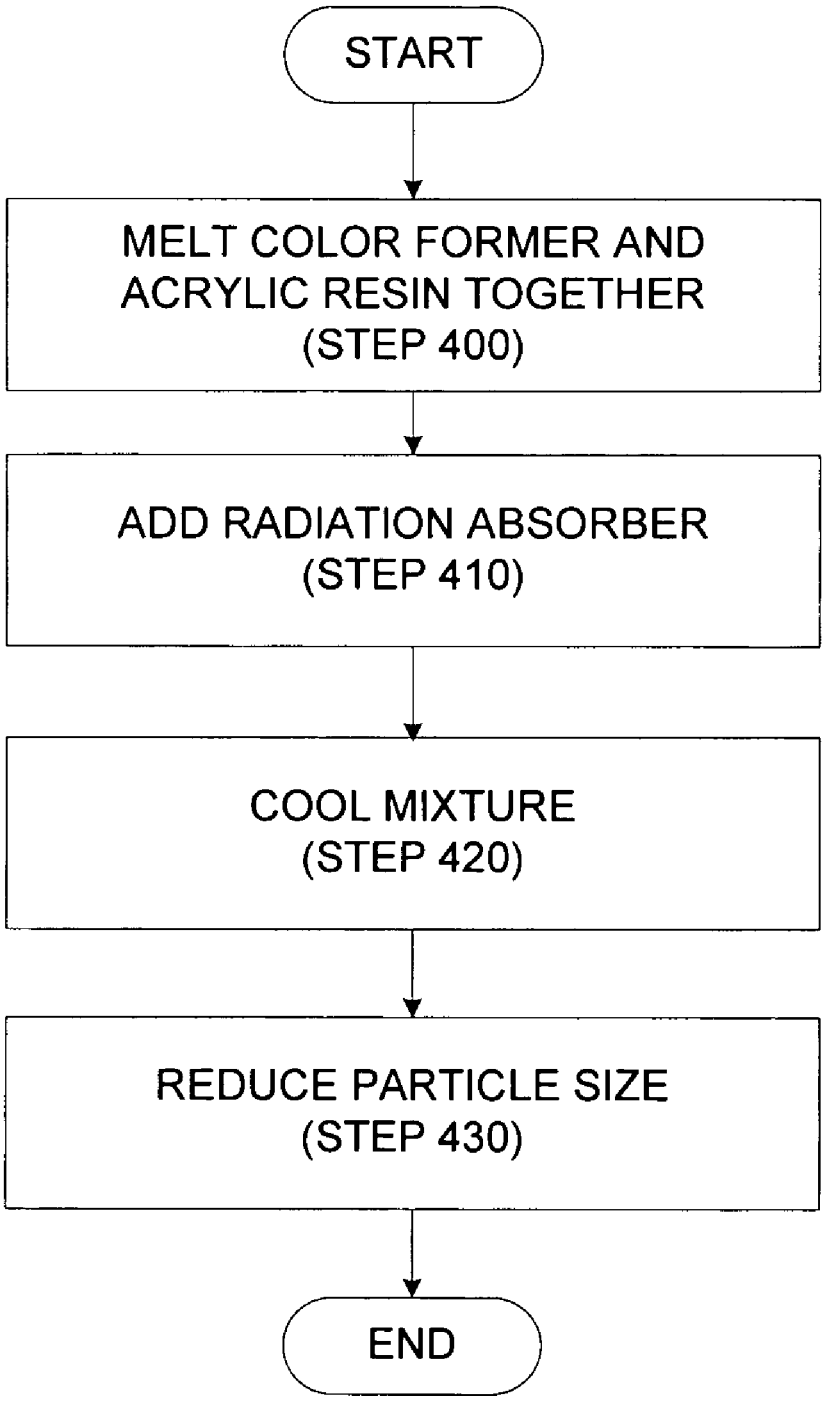
FIG. 4 is a flow chart illustrating a method for forming a radiation image-able composition, according to one exemplary embodiment.

FIG. 4 is a flowchart illustrating a method of preparing a color former phase according to one exemplary embodiment. As illustrated, the present exemplary method begins by melting together a color former and an acrylic resin (step 400). As used herein, the term "color former" refers to any composition that changes color upon application of energy. Color formers may include, but are in no way limited to, leuco dyes, photochromic dyes, or the like. For example, the color former may include leuco dyes, such as fluoran, isobenzofuran, and phthalide-type leuco dyes. The term "color former" does not infer that color is generated from scratch, as it includes materials that can change in color, as well as materials that can become colored from a colorless or more transparent state or a different color. The resulting molten mixture may be referred to as a molten color former phase.

It may also be desirable to add a radiation absorber to the molten mixture (step 410). According to one exemplary method, the resulting color former includes approximately 93.5% wt of a leuco dye commonly known as bk 400, 4.7% wt paraloid b-60, and 1.8% wt radiation absorber, such as a phthalocyanine dye. As introduced, a color forming composition includes an activator phase and a color former phase. Further, as discussed, a radiation absorber may be included in either the color former phase and/or the activator phase.

Once the components are melted, the molten color former phase is allowed to cool (step 420). As the molten color former phase is allowed to cool, the acrylic resin reduces the re-crystallization of the individual components. The particle size of the solid color former phase is then reduced (step 430) in preparation for being mixed with other components.

Accordingly, the present method reduces the re-crystallization of individual components of a color former phase. By reducing the re-crystallization of the individual components, the stability of the color former may be increased, thus reducing the possibility that the individual components will later re-crystallize. As a result, the color former phase may have a relatively long shelf life. Several exemplary components will now be discussed in more detail.

Color Formers

Color forming compositions of the present system and method can include a color former phase dispersed or dissolved within the alloyed activator phase. It may be desirable to uniformly disperse the color former phase throughout the polymer matrix. Further, a dispersion of color former phase within the polymer matrix can be formed as a single composition, e.g., a paste, which can then be coated on a substrate in a single step. The volume of color former phase dispersed within the polymer matrix can vary considerably depending on the concentration and type of color former used, as well as a number of other factors such as desired development speed, desired color intensity of developed color former, and the like. The color former phase volume percent in the polymer matrix can be for example about 30%.

Typical lasers used for marking optical disks, for example, include those that range in wavelength from about 200 nm to about 1200 nm, i.e., 0.2 μm to about 1.2 μm. By providing particles that are of the same order or smaller of magnitude as the wavelength of the laser that is used, light scattering is minimized or removed. In other words, light scattering caused by interaction of laser radiation with larger color former phase particles can result in partial reflection of the laser beam, causing energy loss.

The color former phase can include a variety of materials, including at least one color former. Exemplary color formers include, but are in no way limited to, leuco dyes, photochromic dyes, and the like. Fluoran leuco dyes have been shown to be particularly practical in accordance with embodiments of the present system and method, though other leuco dyes can also be used. For example, the leuco dye can be a fluoran, phthalide, aminotriarylmethane, isobenzofuranone, or mixture thereof. Suitable leuco dyes include, but are not limited to, fluorans, phthalides, amino-triarylmethanes, aminoxanthenes, aminothioxanthenes, amino-9,10-dihydro-acridines, aminophenoxazines, aminophenothiazines, aminodihydrophenazines, aminodiphenylmethanes, aminohydrocinnamic acids (cyanoethanes, leuco methines) and corresponding esters, 2(phydroxyphenyl)-4,5-diphenylimidazoles, indanones, leuco indamines, hydrozines, leuco indigoid dyes, amino-2,3-dihydroanthraquinones, tetrahalo-p,p'-biphenols, 2(phydroxyphenyl)-4,5-diphenylimidazoles, phenethylanilines, phthalocyanine precursors (such as those available from Sitaram Chemicals, India), and mixtures thereof.

As mentioned, fluoran based leuco dyes have proven useful for incorporation into the color forming compositions of the present compositions and methods. Several non-limiting examples of suitable fluoran based leuco dyes include 3-diethylamino-6-methyl-7-anilinofluorane, 3-(N-ethyl-ptoluidino)-6-methyl-7-anilinofluorane, 3-(N-ethyl-N-isoamylamino)-6-methyl-7-anilinofluorane, 3-diethylamino-6-methyl-7-(o,p-dimethylanilino)fluorane, 3-pyrrolidino-6-methyl-7-anilinofluorane, 3-piperidino-6-methyl-7-anilinofluorane, 3-(N-cyclohexyl-N-methylamino)-6-methyl-7-anilinofluorane, 3-diethylamino-7-(m-trifluoromethylanilino)fluorane, 3-dibutylamino-6-methyl-7-anilinofluorane, 3-diethylamino-6-chloro-7-anilinofluorane, 3-dibutylamino-7-(o-chloroanilino) fluorane, 3-diethylamino-7-(ochloroanilino)fluorane, 3-di-n-pentylamino-6-methyl-7-anilinofluoran, 3-di-n-butylamino-6-methyl-7-anilinofluoran, 3-(n-ethyl-n-isopentylamino)-6-methyl-7-anilinofluoran, 3-pyrrolidino-6-methyl-7-anilinofluoran, 1(3H)-isobenzofuranone,4,5,6,7-tetrachloro-3,3-bis[2-[4-(dimethylamino)phenyl]-2-(4-methoxyphenyl) ethenyl], 2-anilino-3-methyl-6-(N-ethyl-N-isoamylamino) fluorane (S-205 available from Nagase Co., Ltd), and mixtures thereof. Aminotriarylmethane leuco dyes can also be used in the present compositions and methods such as tris(N, N-dimethylaminophenyl)methane (LCV); deutero-tris(N,N-dimethylaminophenyl)methane (D-LCV); tris(N, N-diethylaminophenyl)methane (LECV); deutero-tris (4-diethylaminolphenyl)methane (D-LECV); tris(N,N-di-n-propylaminophenyl)methane (LPCV); tris(N,N-din-butylaminophenyl)methane (LBCV); bis(4-diethylaminophenyl)-(4-diethylamino-2-methyl-phenyl) methane (LV-1); bis(4-diethylamino-2-methylphenyl)-(4-diethylamino-phenyl)methane (LV-2); tris(4-diethylamino-2-methylphenyl)methane (LV-3); bis(4-diethylamino-2-methylphenyl)(3,4-dimethoxyphenyl)methane (LB-8); aminotriarylmethane leuco dyes having different alkyl substituents bonded to the amino moieties wherein each alkyl group is independently selected from C1-C4 alkyl; and aminotriaryl methane leuco dyes with any of the preceding named structures that are further substituted with one or more alkyl groups on the aryl rings, wherein the latter alkyl groups are independently selected from C1-C3 alkyl. Other color formers can also be used in connection with the present exemplary system and method and are known to those skilled in the art. Another class of dyes is the phthalide color formers such as crystal violet lactone (CAS# 1552-42-7) available from the Nagase corporation, and Divinyl phthtalide dyes such as NIR black 78, CAS# 113915-68-7, available from the Nagase corporation, containing isobenzofuranone substructure.

A more detailed discussion of leuco dyes can be found in U.S. Pat. Nos. 3,658,543 and 6,251,571, each of which are hereby incorporated by reference in their entireties. Additional examples are found in *Chemistry and Applications of Leuco Dyes*, Muthyala, Ramaiha, ed.; Plenum Press, New York, London; ISBN: 0-306-45459-9, which is incorporated herein by reference.

Typically, the leuco dye can be present in color forming compositions of the present system and method at from about 30 wt % to about 35% wt. Although amounts outside this range can be successfully used, depending on the other components of the composition, amounts from about 20 wt % to about 40 wt % frequently provide adequate results.

In order to reduce development times and increase sensitivity to an applied radiation source, the color former phase can further include a melting aid, according to one exemplary embodiment. Suitable melting aids can have a melting temperature from about 500° C. to about 1500° C. and often from about 700° C. to about 1200° C. Melting aids are typically crystalline organic solids that can be melted and mixed with a particular color former. For example, most color formers are also available as a solid particulate that is soluble in standard liquid solvents. Thus, the color former and melting aid can be mixed and heated to form a molten mixture. Upon cooling, a color former phase of color former and melting aid is formed that can then be ground into a powder. In some embodiments, the percent of color former and melting aid can be adjusted to minimize the melting temperature of the color former phase without interfering with the development properties of the leuco dye. When used, the melting aid can comprise from about 2 wt % to about 25 wt % of the color former phase.

A number of melting aids can be effectively used in the color forming compositions of the present system and method. Several non-limiting examples of suitable melting aids include m-terphenyl, p-benzyl biphenyl, alpha-napthyl benzylether, 1,2-bis(3,4)dimethylphenyl ethane, and mixtures thereof. Suitable melting aids can also include aromatic hydrocarbons (or their derivatives) that provide good solvent characteristics with the leuco dye and radiation absorbers used in the formulations and methods of the present system and method. In addition to dissolving the color former and radiation absorber, the melting aid can also assist in reducing the melting temperature of the color former and stabilize the color former phase in the amorphous state (or at least slow down recrystallization of the color former phase into individual components). In general, any material having a high solubility and/or miscibility with the color former to form a glass or co-crystalline phase with the dye and alters the melting property of the dye may be useful in this process. For example, aromatic hydrocarbons, phenolic ethers, aromatic acid-esters, long chain (C6 or greater) fatty acid esters, polyethylene wax, or the like can also be suitable melting aids. Additional materials can also be included in the color former phase such as, but not limited to, stabilizers, anti-oxidants, non-leuco colorants, radiation absorbers, and the like.

Radiation Absorbers

A radiation absorber can also be included in the color forming compositions of the present compositions and methods. The radiation absorber is typically present as a component that can be used to optimize development of the color forming composition upon exposure to radiation at a predetermined exposure time, energy level, wavelength, etc. The radiation absorber can act as an energy antenna, providing energy to surrounding areas upon interaction with an energy source. As a predetermined amount of energy can be provided by the marking device (120; FIG. 1), matching the radiation wavelength and intensity to the particular radiation absorber used can optimize the system. Optimizing the system includes a process of selecting components of the color forming composition that can result in a rapidly developable composition under a fixed period of exposure to radiation at a specified power. For example, compositions of the present system and method can be optimized for development using at a predetermined wavelength of laser energy, e.g., 405 nm, 650 nm, 780 nm, 980 nm, or 1084 nm, in which the color forming composition exposed to the radiation is developed in less than a predetermined period of time, e.g., less than 100 μsec. However, "optimized" does not necessarily indicate that the color forming composition is developed most rapidly at a specific wavelength, but rather that the composition can be developed within a specified time frame using a given radiation source.

An optimized composition can also indicate an ambient light stability over extended periods of time, i.e., several months to years. Thus, an optimized composition results from a combination of all components of the color forming composition in affecting development characteristics and stability. To illustrate, in formulating the color forming composition of the present system and method, an optimized composition can depend on a variety of factors, since each component can affect the development properties, e.g., time, color intensity, etc.

For example, a color forming composition having a radiation antenna with a maximum absorption of about 780 nm may not develop most rapidly at 780 nm. Other components and the specific formulation can result in an optimized composition at a wavelength that does not correspond to the maximum absorption of the radiation antenna. Thus, the process of formulating an optimized color forming composition can include testing formulations to achieve a desired development time using a specific intensity and wavelength of energy to form an acceptable color change.

The radiation absorber can be configured to be in a heat-conductive relationship with the color formers of the present system and method. For example, the radiation absorber can be included within the color former phase, the polymer matrix, and/or a separate layer. Thus, the radiation absorber can be admixed with or in thermal contact with the color forming composition.

Typically, the radiation absorber can be present in both the color former phase and the alloyed activator phase. In this way, substantially the entire color forming composition in an exposed area can be heated quickly and substantially simultaneously. Alternatively, the radiation absorber can be applied as a separate layer that can be optionally spin-coatable or screen-printable, for example.

Suitable radiation antenna can be selected from a number of radiation absorbers such as, but not limited to, aluminum quinoline complexes, porphyrins, porphins, indocyanine dyes, phenoxazine derivatives, phthalocyanine dyes, polymethyl indolium dyes, polymethine dyes, guaiazulenyl dyes, croconium dyes, polymethine indolium dyes, metal complex IR dyes, cyanine dyes, squarylium dyes, chalcogeno-pyryloarylidene dyes, indolizine dyes, pyrylium dyes, quinoid dyes, quinone dyes, azo dyes, and mixtures or derivatives thereof. Other suitable antennas can also be used in the present system and method and are known to those skilled in the art and can be found in such references as *Infrared Absorbing Dyes*, Matsuoka, Masaru, ed., Plenum Press, N.Y., 1990 (ISBN 0-306-43478-4) and *Near-Infrared Dyes for High Technology Applications*, Daehne, Resch-Genger, Wolfbeis, Kluwer Academic Publishers (ISBN 0-7923-5101-0), both of which are incorporated herein by reference.

Consideration can also be given to choosing the radiation antenna such that any light absorbed in the visible range does not adversely affect the graphic display or appearance of the color forming composition either before or after development. For example, in order to achieve a visible contrast between developed areas and non-imaged or non-developed areas of the coating, the color former can be chosen to form a color that is different than that of the background. For example, color formers having a developed color such as black, blue, red, magenta, and the like can provide a good contrast to a more yellow background. Optionally, an additional non-color former colorant can be added to the color forming compositions of the present system and method or the substrate on which the color forming composition is placed. Any known non-color former colorant can be used to achieve almost any desired background color for a given commercial product. Although the specific color formers and antennae discussed herein are typically separate compounds, such activity can also be provided by constituent groups of binders and/or color formers which are incorporated in the activation and/or radiation absorbing action of color formers. These types of color former/radiation absorbers are also considered to be within the scope of the present system and method.

Various radiation antennas can act as an antenna to absorb electromagnetic radiation of specific wavelengths and ranges. Generally, a radiation antenna that has a maximum light absorption at or in the vicinity of the desired development wavelength can be suitable for use in the present system and method. For example, in one aspect of the present system and method, the color forming composition can be optimized within a range for development using infrared radiation having a wavelength from about 720 nm to about 900 nm in one embodiment.

Common CD-burning lasers have a wavelength of about 780 nm and can be adapted for forming images by selectively developing portions of the color forming composition. Radiation antennae which can be suitable for use in the infrared range can include, but are not limited to, polymethyl indoliums, metal complex IR dyes, indocyanine green, polymethine dyes such as pyrimidinetrione-cyclopentylidenes, guaiazulenyl dyes, croconium dyes, cyanine dyes, squarylium dyes, chalcogenopyryloarylidene dyes, metal thiolate complex dyes, bis(chalcogenopyrylo)polymethine dyes, oxyindolizine dyes, bis(aminoaryl)polymethine dyes, indolizine dyes, pyrylium dyes, quinoid dyes, quinone dyes, phthalocyanine dyes, naphthalocyanine dyes, azo dyes, hexafunctional polyester oligomers, heterocyclic compounds, and combinations thereof.

Several specific polymethyl indolium compounds that can be used are available from Aldrich Chemical Company, and include 2-[2-[2-chloro-3-[2-(1,3-dihydro-1,3,3-trimethyl-2H-indol-2-ylidene)-ethylidene]-1-cyclopenten-1-yl-ethenyl]-1,3,3-trimethyl-3H-indolium perchlorate; 2-[2-[2-Chloro-3-[2-(1,3-dihydro-1,3,3-trimethyl-2H-indol-2-ylidene)-ethylidene]-1-cyclopenten-1-yl-ethenyl]-1,3,3-trimethyl-3H-indolium chloride; 2-[2-[2-chloro-3-[(1,3-dihydro-3,3-dimethyl-1-propyl-2H-indol-2-ylidene) ethylidene]-1-cyclohexen-1-yl]ethenyl]-3,3-dimethyl-1-propylindolium iodide; 2-[2-[2-chloro-3-[(1,3-dihydro-1,3,3-trimethyl-2H-indol-2-ylidene)ethylidene]-1-cyclohexen-1-yl]ethenyl]-1,3,3-trimethylindolium iodide; 2-[2-[2-chloro-3-[(1,3-dihydro-1,3,3-trimethyl-2H-indol-2-ylidene) ethylidene]-1-cyclohexen-1-yl]ethenyl]-1,3,3-trimethylindolium perchlorate; 2-[2-[3-[(1,3-dihydro-3,3-dimethyl-1-propyl-2H-indol-2-ylidene)ethylidene]-2-(phenylthio)-1-cyclohexen-1-yl]ethenyl]-3,3-dimethyl-1-propylindolium perchlorate; and mixtures thereof. Alternatively, the radiation antenna can be an inorganic compound, e.g., ferric oxide, carbon black, selenium, or the like. Polymethine dyes or derivatives thereof such as a pyrimidinetrione-cyclopentylidene, squarylium dyes such as guaiazulenyl dyes, croconium dyes, or mixtures thereof can also be used in the present system and method. Suitable pyrimidinetrione-cyclopentylidene infrared antennae include, for example, 2,4,6(1H,3H,5H)-pyrimidinetrione 5-[2,5-bis[(1,3-dihydro-1,1,3-dimethyl-2H-indol-2-ylidene)ethylidene]cyclopentylidene]-1,3-dimethyl-(9CI) (S0322 available from Few Chemicals, Germany).

Further, the radiation antenna can be selected for optimization of the color forming composition in a wavelength range from about 600 nm to about 720 nm, such as about 650 nm. Non-limiting examples of suitable radiation antennae for use in this range of wavelengths can include indocyanine dyes such as 3H-indolium,2-[5-(1,3-dihydro-3,3-dimethyl-1-propyl-2H-indol-2-ylidene)-1,3-pentadienyl]-3,3-dimethyl-1-propyl-,iodide) (Dye 724 λmax 642 nm), 3H-indolium,1-butyl-2-[5-(1-butyl-1,3-dihydro-3,3-dimethyl-2H-indol-2-ylidene)-1,3-pentadienyl]-3,3-dimethyl-,perchlorate (Dye 683 λmax 642 nm), and phenoxazine derivatives such as phenoxazin-5-ium,3,7-bis(diethylamino)-,perchlorate (oxazine 1 λmax=645 nm). Phthalocyanine dyes having a λmax of about the desired development wavelength can also be used, such as silicon 2,3-napthalocyanine bis(trihexylsilyloxide) and matrix soluble derivatives of 2,3-napthalocyanine (both commercially available from Aldrich Chemical); matrix soluble derivatives of silicon phthalocyanine (as described in Rodgers, A. J. et al., 107 J. Phys. Chem. A 3503-3514, May 8, 2003), and matrix soluble derivatives of benzophthalocyanines (as described in Aoudia, Mohamed, 119 J. Am. Chem. Soc. 6029-6039, Jul. 2, 1997); phthalocyanine compounds such as those described in U.S. Pat. Nos. 6,015,896 and 6,025,486, which are each incorporated herein by reference; and Cirrus 715 (a phthalocyanine dye available from Avecia, Manchester, England having a λmax=806 nm).

Laser light having blue and indigo wavelengths from about 300 nm to about 600 nm can also be used to develop the color forming compositions, according to one exemplary embodiment. Consequently, color forming compositions may be selected for use in devices that emit wavelengths within this range. Recently developed commercial lasers found in certain DVD and laser disk recording equipment provide for energy at a wavelength of about 405 nm. Thus, the compositions discussed herein using appropriate radiation antennae can be suited for use with components that are already available on the market or are readily modified to accomplish imaging.

Radiation antennae which can be useful for optimization in the blue (~405 nm) and indigo wavelengths can include, but are not limited to, aluminum quinoline complexes, porphyrins, porphins, and mixtures or derivatives thereof. Non-limiting specific examples of suitable radiation antenna can include 1-(2-chloro-5-sulfophenyl)-3-methyl-4-(4-sulfophenyl)azo-2-pyrazolin-5-one disodium salt (□max=400 nm); ethyl 7-diethylaminocoumarin-3-carboxylate (□ max=418 nm); 3,3'-diethylthiacyanine ethylsulfate (□max=424 nm); 3-allyl-5-(3-ethyl-4-methyl-2-thiazolinylidene)rhodanine (□ max=430 nm) (each available from Organica Feinchemie GmbH Wolfen), and mixtures thereof.

Non-limiting specific examples of suitable aluminum quinoline complexes can include tris(8-hydroxyquinolinato) aluminum (CAS 2085-33-8), and derivatives such as tris(5-cholor-8-hydroxyquinolinato)aluminum (CAS 4154-66-1), 2-(4-(1-methyl-ethyl)-phenyl)-6-phenyl-4H-thiopyran-4-ylidene)-propanedinitril-1,1-dioxide (CAS 174493-15-3), 4,4'-[1,4-phenylenebis(1,3,4-oxadiazole-5,2-diyl)]bis N,N-diphenyl benzeneamine (CAS 184101-38-0), bis-tetraethylammonium-bis(1,2-dicyano-dithiolto)-zinc(II) (CAS 21312-70-9), 2-(4,5-dihydronaphtho[1,2-d]-1,3-dithiol-2-ylidene)-4,5-dihydro-naphtho[1,2-d]1,3-dithiole, all available from Syntec GmbH.

Non-limiting examples of specific porphyrin and porphyrin derivatives can include etioporphyrin 1 (CAS 448-71-5), deuteroporphyrin IX 2,4 bis ethylene glycol (D630-9) available from Frontier Scientific, and octaethyl porphrin (CAS 2683-82-1), azo dyes such as Mordant Orange (CAS 2243-76-7), Merthyl Yellow (CAS 60-11-7), 4-phenylazoaniline (CAS 60-09-3), Alcian Yellow (CAS 61968-76-1), available from Aldrich chemical company, and mixtures thereof.

In each of these embodiments, generally, the radiation absorber can be present in the color forming composition as a whole at from about _0.5_ wt % to about _3_ wt %, and typically, from about _1.5_ wt % to about _2_ wt %, although other weight ranges may be desirable depending on the molar absorbtivity of the particular radiation absorber.

Alloyed Activator Phase

Exemplary color forming compositions include an alloyed activator phase, which comprises at least a polymer matrix and an activator. In one embodiment, the alloyed activator phase includes a sulfonamide activator. As mentioned above, a color former phase is finely dispersed within the polymer phase containing activator. Exemplary color former phases will be discussed in more detail below. Various polymer matrix materials can influence the development properties of the color forming composition such as development speed, light stability, and wavelengths that can be used to develop the color forming composition.

In addition to the polymer matrix and the activator, other optional ingredients can also be present in the alloyed activator phase. For example, the preparation of the alloyed activator phase can also include the preparation of a stabilizer capable of stabilizing the color former after melting the two phases together, when the color former is in its post-development colored state. As introduced, the stabilizer may include acrylic resins, which are combined with molten activators and a radiation absorber to form an amorphous solid activator phase. The amorphous solid activator phase may then be dissolved in the polymer matrix to form an alloyed activator phase.

The alloyed activator phase also includes an activator. Suitable activators include sulfonamides, such as sulfonyl urea. The use of sulfonamides may provide for some of the alloyed activator phases to show excellent image stability due to unique complexes and structures formed upon reaction with certain color formers, such as fluoran color formers, resulting in stable color and images.

Acceptable polymer matrix materials can include, by way of example, UV curable polymers such as acrylate derivatives, oligomers, and monomers. These materials are often included or assembled as part of a photo package. A photo package can include a light absorbing species that initiates reactions for curing of a lacquer. Such light absorbing species can be sensitized for curing, and include, by way of example, benzophenone derivatives. Other examples of photoinitiators for free radical polymerization monomers and pre-polymers can include, but are not limited to, thioxanethone derivatives, anthraquinone derivatives, acetophenones, and benzoine ethers.

It may be desirable to choose a polymer matrix that is cured by a form of radiation that does not also develop the color former or otherwise decrease the stability of the color forming composition at the energy input and flux used to cure the coatings. Thus, the polymer matrix can be curable at a curing wavelength that is other than the developing wavelength of the color forming composition. For example, in one embodiment, the curing wavelength can be in the ultraviolet (UV) range and the developing wavelength can be in the infrared range.

Alternatively, the curing wavelength and the developing wavelength can both be in the UV range, but may be different enough such that the curing wavelength does not substantially cause undesired development of the color forming composition. For example, selecting a first UV wavelength of 405 nm for the developing wavelength and a second UV wavelength of about 200 nm to about 380 nm for the curing wavelength of the polymer matrix may provide an effective system for curing the polymer without prematurely developing the color forming composition.

Polymers can include certain photoinitiators for initiating curing upon exposure to radiation. Suitable photoinitiators should also have a light absorption band that is not obscured by the absorption band of the radiation absorber (as will be discussed hereinafter), otherwise the radiation absorber can interfere with photoinitiator activation, and thus, prevent proper curing of the coating.

Therefore, in one practical embodiment of the present exemplary system and method, a photoinitiator light absorption band can lie within the UV region, e.g., from about 200 nm to about 380 nm, and the absorber band can lie outside of this range, e.g., from about 390 to about 1100 nm. In practice, the lower end of the radiation absorber band would likely overlap with the UV wavelength range used for polymer curing. However, a working system design is possible because the energy flux used for development of a color former is about 10 times higher than the energy flux used for initiation of polymer curing. In yet another embodiment, the absorber has a dual function; one of sensitization of UV cure under cure conditions (relatively low energy flux), and another of providing energy for marking during the marking function. This may be possible because the energy flux during cure is typically an order of magnitude lower than needed for producing a mark.

Polymers can also include certain photoinitiators for initiating curing upon exposure to radiation. Suitable photoinitiators may also have a light absorption band that is not obscured by the absorption band of the radiation absorber (as will be discussed hereinafter), otherwise the radiation absorber can interfere with photoinitiator activation, and thus, prevent proper curing of the coating. Therefore, in one exemplary embodiment, a photoinitiator light absorption band can lie within the UV region, e.g., from about 200 nm to about 380 nm, and the absorber band can lie outside of this range, e.g., from about 390 to about 1100 nm.

In practice, the lower end of the radiation absorber band may overlap with the UV wavelength range used for polymer curing. However, a working system design is possible because the energy flux used for development of a color former is about 10 times higher than the energy flux used for initiation of polymer curing.

In yet another embodiment, the radiation absorber has a dual function; one of sensitization of UV cure under cure conditions (relatively low energy flux), and another of providing energy for marking during the marking function. This may be possible because the energy flux used during cure is typically an order of magnitude lower than the energy flux used for producing a mark.

Polymer matrix materials based on acrylic polymerization resins can include photo-initiators including aromatic diazonium salts, aromatic halonium salts, aromatic sulfonium salts, and metallocene compounds. Additional examples of curing agents are α-aminoketones, α-hydroxyketones, phosphineoxides available from Ciba-Geigy under the name of Irgacure and Darocure agents, and sensitizers such as 2-isopropyl-thioxanthone.

One specific example of a suitable polymer matrix is Nor-Cote CDG-1000 (a mixture of UV curable acrylate monomers and oligomers), which contains a photoinitiator (hydroxy ketone) and organic solvent acrylates, e.g., methyl methacrylate, hexyl methacrylate, beta-phenoxy ethyl acrylate, and hexamethylene acrylate, available from Nor-Cote. Other suitable components for polymer matrix materials can include, but are not limited to, acrylated polyester oligomers, such as CN293 and CN294 as well as CN-292 (low viscosity polyester acrylate oligomer), SR-351 (trimethylolpropane triacrylate), SR-395(isodecyl acrylate), and SR-256(2(2-ethoxyethoxy)ethyl acrylate), all of which are available from Sartomer Co.

Additionally, binders can be included as part of the polymer matrix. Suitable binders can include, but are not limited to, polymeric materials such as polyacrylate from monomers and oligomers, polyvinyl alcohols, polyvinyl pyrrolidines, polyethylenes, polyphenols or polyphenolic esters, polyurethanes, acrylic polymers, and mixtures thereof. For example, the following binders can be used in the color forming composition of the present system and method: cellulose acetate butyrate, ethyl acetate butyrate, polymethyl methacrylate, polyvinyl butyral, and mixtures thereof.

Accordingly, the polymer matrix of the alloyed activator phase can be a group of polymers. The polymers can act as a solute of the alloyed activator phase, or can be dissolved or dispersed in another material, such as a solvent or another component of the phase. If multiple polymers are present, the polymers can be blended, crosslinked, or otherwise combined. In one embodiment, the polymer matrix can include a radiation curable polymer or system of polymers, olligomers, and/or monomers, etc. Though the polymer matrix is integral to the alloyed activator phase, it can be present in any of a number of forms.

The alloyed activator phase also includes an activator, which depending on the color former used in the color former phase, can be a reducing agent. Typical activators that can be used include any of a variety of acids. Non-limiting examples of suitable activators include bis-phenol A, bis-phenol S,p-hydroxy benzyl benzoate, TG-SA (Phenol, 4,4-α-sulfonylbis [2-(2-propenyl)), and poly-phenols. Examples of additional acidic materials that can be use as activators include any lewis acid, without limitation, phenols, carboxylic acids, cyclic sulfonamides, protonic acids, zinc chloride, magnesium carboxylates, zinc carboxylates, calcium carboxylates, transistion metal salts and other compounds having a pKa of less than about 7.0, and mixtures thereof. Specific phenolic and carboxylic secondary activators can include, without limitation, boric acid, oxalic acid, maleic acid, tartaric acid, citric acid, succinic acid, benzoic acid, stearic acid, gallic acid, salicylic acid, 1-hydroxy-2-naphthoic acid, o-hydroxybenzoic acid, m-hydroxybenzoic acid, 2-hydroxy-p-toluic acid, 3,5-xylenol, thymol, p-t-butylphenyl, 4-hydroxyphenoxide, methyl-4-hydroxybenzoate, 4-hydroxyacetophenone, α-naphthol, naphthols, catechol, resorcin, hydroquinone, 4-t-octylcatechol, 4,4'-butylidenephenol, 2,2'-dihydroxydiphenyl, 2,2'-methylenebis(4-methyl-6-t-butyl-phenol), 2,2'-bis (4'-hydroxyphenyl)propane, 4,4'-isopropylidenebis(2-t-butylphenol), 4,4'-secbutylidenediphenol, pyrogallol, phloroglucine, phlorogluocinocarboxylic acid, 4-phenylphenol, 2,2'-methylenebis(4-chlorophenyl), 4,4'-isopropylidenediphenol, 4,4'-isopropylidenebis(2-chlorophenol), 4,4'-isopropylidenebis(2-methylphenol), 4,4'-ethylenebis(2-methyl phenol), 4,4'-thiobis(6-t-butyl-3-methyl phenol), bisphenol A and its derivatives (such as 4,4'-isopropylidenediphenol, 4-4'-cyclohexylidenediphenol, p,p'-(1-methyl-n-hexylidene) diphenol, 1,7-di(4-hydroxyphenylthio)-3,5-dioxaheptane), 4-hydroxybenzoic esters, 4-hydroxyphthalic diesters, phthalic monoesters, bis(hydroxyphenyl)sulfides, 4-hydroxyarylsulfones, 4-hydroxyphenylarylsulfonates, 1,3-di [2-(hydroxyphenyl)-2-propyl]benzenes, 1,3-dihydroxy-6(α, α-dimethylbenzyl)benzene, resorcinols, hydroxybenzoyloxybenzoic esters, bisphenolsulfones, bis-(3-allyl-4-hydroxyphenyl)sulfone (TG-SA), bisphenolsulfonic acids, 2,4-dihydroxy-benzophenones, novolac type phenolic resins, polyphenols, saccharin, 4-hydroxy-acetophenone, p-phenylphenol, benzyl-p-hydroxybenzoate (benzalparaben), 2,2-bis(p-hydroxyphenyl) propane, p-tert-butylphenol, 2,4-dihydroxy-benzophenone, and p-benzylphenol.

Typically, the activator will be present in the color forming composition as a whole at from 5 wt % to about 25 wt %. Because the activator is present in the alloyed activator phase, activator will typically remain predominantly in this phase until the alloyed activator phase becomes at least partially molten and the color former phase begins to melt with the alloyed activator phase. In other words, by including the activator in the alloyed activator phase, the activator is kept substantially separated from the color former phase until the composition is heated. Upon heating with laser energy, the alloyed activator phase can become molten and the particles of the color former phase become melted therein. Upon melting, the activator contacts the color former, thereby causing a selective modification in color of the color former, e.g., leuco dye. In another example, the polymeric activator alloy is prepared to facilitate the dissolution of the alloy components into the uv-curable matrix and in which the color former remains in a solid phase separate from the activator.

Polymer matrix materials based on cationic polymerization resins can comprise of photo-initiators including aromatic diazonium salts, aromatic halonium salts, aromatic sulfonium salts, and metallocene compounds. Additional examples of curing agents include, but are in no way limited to, α-aminoketones, α-hydroxyketones, phosphineoxides available from Ciba-Geigy under the name of Irgacure and Darocure agents, and sensitizers such as 2-isopropyl-thioxanthone. One specific example of a suitable polymer matrix is Nor-Cote CDG-1000 (a mixture of UV curable acrylate monomers and oligomers) that contains a photoinitiator (hydroxy ketone) and organic solvent acrylates, e.g., methyl methacrylate, hexyl methacrylate, beta-phenoxy ethyl acrylate, and hexamethylene acrylate, available form Nor-Cote. Other suitable components for polymer matrix materials can include, but are not limited to, acrylated polyester oligomers, such as CN293 and CN294 as well as CN-292 (low viscosity polyester acrylate oligomer), SR-351 (trimethylolpropane triacrylate), SR-395(isodecyl acrylate), and SR-256(2(2-ethoxyethoxy) ethyl acrylate), all of which are available from Sartomer Co.

Additionally, binders can be included as part of the polymer matrix. Suitable binders can include, but are not limited to, polymeric materials such as polyacrylate from monomers and oligomers, polyvinyl alcohols, polyvinyl pyrrolidines, polyethylenes, polyphenols or polyphenolic esters, polyurethanes, acrylic polymers, and mixtures thereof. For example, the following binders can be used in the color forming composition of the present system and method: cellulose acetate butyrate, ethyl acetate butyrate, polymethyl methacrylate, polyvinyl butyral, and mixtures thereof.

The preceding description has been presented only to illustrate and describe the present method and apparatus. It is not intended to be exhaustive or to limit the disclosure to any precise form disclosed. Many modifications and variations are possible in light of the above teaching. It is intended that the scope of the disclosure be defined by the following claims.

What is claimed is:

1. A color former phase, comprising:

a color former;

a radiation absorber; and an acrylic resin, wherein said color former, said radiation absorber, and said acrylic resin form an amorphous solid.

2. The color former phase of claim 1, wherein said color former comprises a leuco dye.

3. The color former phase of claim 2, wherein said leuco dye comprises a fluoran leuco dye.

4. The color former phase of claim 1, wherein said acrylic resin includes at least one of methyl methylacrylates, butyl methylacrylates and combinations thereof.

5. The color former phase of claim 1, wherein said radiation absorber comprises an infrared dye.

6. A color forming composition, comprising:

a color former phase having at least one color former;

a polymeric activator phase including at least one activator and a polymer matrix;

a radiation absorber in thermal contact with said color former; wherein at least one of said color former phase and said activator phase include an acrylic resin.

7. The color forming composition of claim 6, wherein said acrylic resin is present in said color former phase.

8. The color forming composition of claim 7, wherein said acrylic resin is present in said activator phase.

9. The color forming composition of claim 8, wherein said acrylic resin is present in said color former phase.

10. The color forming composition of claim 6, wherein said color former phase includes an amorphous solid including said color former, said acrylic resin, and said radiation absorber.

11. The color forming composition of claim 10, wherein said amorphous solid is dispersed within activator phase.

12. The color forming composition of claim 6, wherein said color forming composition has a pre-development state and a post-development state, said pre-development state having an appearance that is visually different than said post-development state.

13. The composition of claim 6, wherein said polymer matrix includes a radiation curable polymer.

14. The composition of claim 13, wherein said radiation curable polymer is curable at a curing wavelength that is different than a developing wavelength which would cause said color forming composition to change or develop color.

15. The composition of claim 14, wherein said curing wavelength is in an ultraviolet range.

16. The composition of claim 14, wherein said developing wavelength is in an infrared range.

17. The composition of claim 14, wherein said developing wavelength is from about 200 nm to about 1200 nm.

18. The composition of claim 6, wherein said polymeric activator phase further comprises an aromatic stabilizer.

19. The composition of claim 18, wherein said aromatic stabilizer is configured to stabilize said color former in the post-development state.

20. The composition of claim 6, wherein a first portion of said radiation absorber is dispersed or dissolved within said polymeric activator phase, and wherein a second portion of said radiation absorber is dispersed or dissolved within said color former phase.

21. The composition of claim 6, and further comprising a binder material.

22. The composition of claim 21, wherein said binder includes at least one of poly acrylate, polyvinyl alcohol polyvinylbutryl, cellulose acetate, and cellulose acetate butyrate.

23. The composition of claim 21, wherein said acrylic resin comprises about 7 percent of said activator phase.

24. A method of forming a color former phase, comprising:

melting together a color former and acrylic resin;

adding a radiation absorber to form a molten color former phase; and cooling said molten color former phase to form an amorphous solid color former phase.

25. The method of claim 24, wherein said color former comprises a leuco dye.

26. The method of claim 24, wherein said radiation absorber comprises an infrared dye.

27. A method of forming an activator phase, comprising:

melting at least one activator;

adding acrylic resin to said activator;

adding a radiation absorber;

cooling said activator, acrylic resin, and activator to form an amorphous solid; and dissolving said amorphous solid in a polymer matrix.

28. The method of claim 27, wherein melting at least one activator includes melting a plurality of activators.

29. The method of claim 27, wherein dissolving said amorphous solid includes dissolving said amporphous solid into a UV curable polymer matrix.

30. A method of forming a color forming composition, comprising:

preparing an amorphous color former phase including an acrylic resin;

preparing an activator phase;

dissolving said activator phase in a polymer matrix to form a polymeric activator phase; and combining said amorphous color former phase and said polymeric activator phase.

* * * * *

UNITED STATES PATENT AND TRADEMARK OFFICE

CERTIFICATE OF CORRECTION

PATENT NO. : 7,390,610 B2
APPLICATION NO. : 11/253772
DATED : June 24, 2008
INVENTOR(S) : Michael J. Day It is certified that error appears in the above-identified patent and that said Letters Patent is hereby corrected as shown below:

In column 7, line 35, delete "500°C." and insert -- 50°C. --, therefor.

In column 7, line 35, delete "1500°C." and insert -- 150°C. --, therefor.

In column 7, line 36, delete "700°C." and insert -- 70°C. --, therefor.

In column 7, line 36, delete "1200°C." and insert -- 120°C. --, therefor.

In column 10, line 38, delete "propyl-,iodide" and insert -- propyl-iodide --, therefor.

In column 13, line 55, delete "olligomers" and insert -- oligomers --, therefor.

In column 16, line 29, in Claim 22, after "alcohol" insert -- , --.

In column 16, line 53, in Claim 29, delete "amporphous" and insert -- amorphous --, therefor.

Signed and Sealed this

Eighteenth Day of August, 2009

David J. Kappos

David J. Kappos
*Director of the United States Patent and Trademark Office*